US006115965A

United States Patent [19]

Jennings

[11] Patent Number: 6,115,965

[45] Date of Patent: Sep. 12, 2000

[54] POWER OPERATOR FOR VEHICLE LIFTGATE

[75] Inventor: Steven E. Jennings, Adrian, Mich.

[73] Assignee: Dura Convertible Systems, Adrian, Mich.

[21] Appl. No.: 08/987,228

[22] Filed: Dec. 9, 1997

[51] Int. Cl.[7] ..... E05F 15/02

[52] U.S. Cl. ..... 49/334; 49/340

[58] Field of Search ..... 49/333, 334, 339, 49/340, 139, 140

[56] References Cited

U.S. PATENT DOCUMENTS

| | | | |
|---|---|---|---|
| 3,195,879 | 7/1965 | Bond et al. | 49/334 X |
| 3,301,313 | 1/1967 | Schurink | 49/334 X |
| 3,938,282 | 2/1976 | Goyal | 49/138 X |
| 5,448,856 | 9/1995 | Moore et al. | 49/340 |
| 5,588,258 | 12/1996 | Wright et al. | 49/340 |

*Primary Examiner*—Jerry Redman
*Attorney, Agent, or Firm*—David A. Greenlee

[57] ABSTRACT

A power operator raises and lowers a vehicle liftgate to open and close a vehicle rear hatch. A pair of double-acting hydraulic cylinders pivotally interconnect the vehicle and the liftgate to move the liftgate through a raise cycle and a lower cycle. First and second branches of hydraulic circuitry connect an electrohydraulic pump assembly and a hydraulic accumulator to the cylinders. A controller isolates the accumulator and causes the pump assembly to power the initial portion of the liftgate raise cycle through the first circuit branch. When the liftgate reaches a predetermined position, the controller deactuates the pump assembly and connects the accumulator to the first branch to power the remainder of the liftgate raise cycle. Fluid exhausts through the second branch to the pump assembly. The pump powers the liftgate lower cycle through the second branch, while cylinder exhaust fluid flowing through the first branch recharges the accumulator. The pump assembly can include a single direction motor-driven pump and a directional valve, or a bi-directional motor-driven pump. If power fails, the accumulator connects to the cylinders to assist manual raising of the liftgate and to be recharged during manual lowering of the liftgate. The reservoir is sized to contain all system hydraulic fluid and configured to conform to available vehicle space.

7 Claims, 7 Drawing Sheets

FIG 1
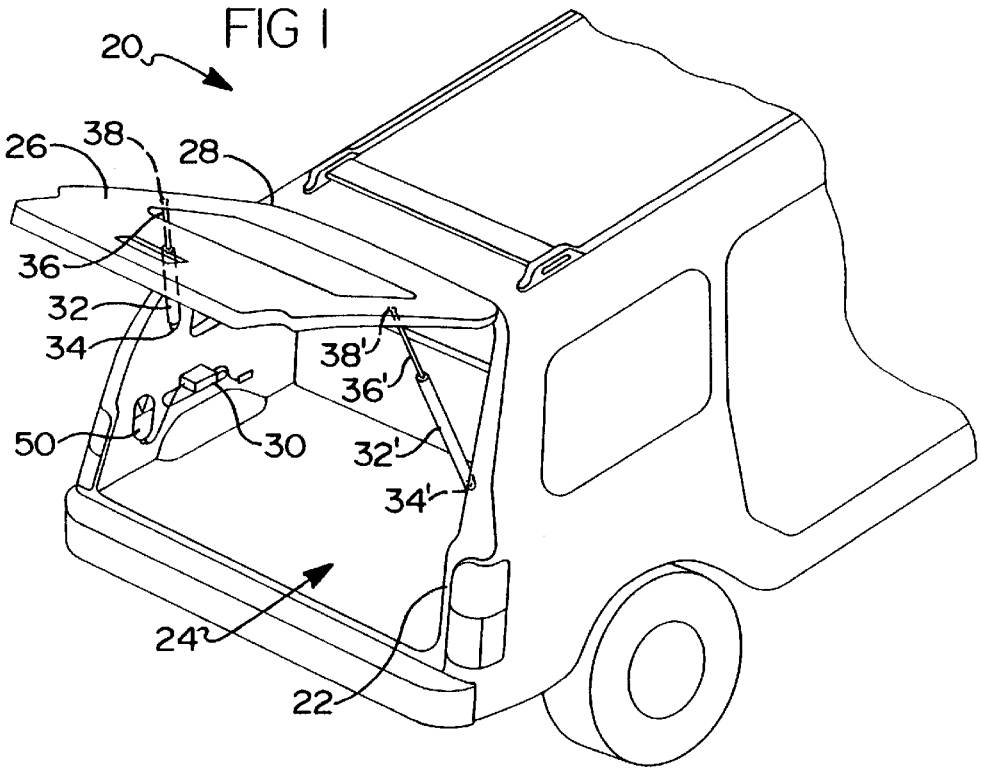
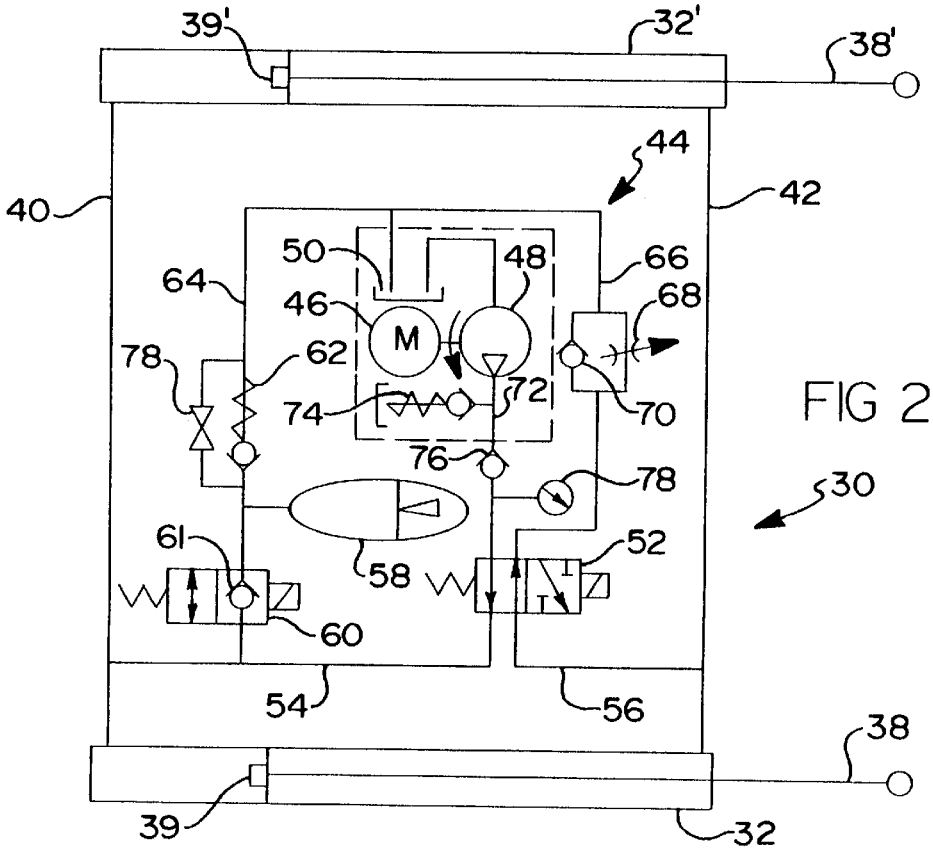
FIG 2

POWER OPERATOR FOR VEHICLE LIFTGATE

BACKGROUND OF THE INVENTION

This invention relates generally to vehicle liftgates and, more particularly, to a power operator for raising and lowering liftgate.

Vans, station wagons and sport-utility vehicles (SUVs) all have rear doors, generically called tailgates, which provide access to the vehicle's rear cargo area through a rear opening. In some vehicles, pairs of doors are vertically hinged at the sides of the vehicle rear opening to open horizontally. In others, pairs of doors are horizontally hinged at the top and bottom of the rear opening to open vertically up and down like a clamshell.

In yet other vehicles, a single door or liftgate is horizontally hinged at the top of the opening to open upwardly. These doors are usually fitted with gas struts at the sides to provide a spring assist when the door is raised. These gas struts provide added resistance to manual closing of the door.

The vehicles that are provided with the single liftgate are usually upscale vehicles, especially the SUVs. These upscale vehicles are usually provided with a host of convenience accessories, including power equipment to supplant manual operation of the windows, transmission, seats, etc.

The manual liftgates provided with these vehicles require manual effort to both raise and lower the liftgate, even though the gas struts aid lifting and gravity aids lowering. Manual operation also necessitates operator presence at the liftgate for operation, which can be problematic during inclement weather. Upscale vehicle sedans having trunk lids employ a power latch release and gas struts or springs to raise the lid, enabling remote operation to open the lid, but not to close it.

Such operation would be ineffective for an SUV liftgate, due to the kinematics involved. Liftgates are so much heavier than a trunk lid that gas struts or springs strong enough to raise the liftgate would present too great a resistance to manual lowering which would preclude lowering by all but the strongest operators.

There is a need for a power operator for the liftgate in such vehicles which enables remote operation to both raise and lower the liftgate. It would also be desirable to provide a power liftgate operator that facilitates manual operation if the power operator becomes inoperative.

SUMMARY OF THE INVENTION

It is therefore an object of this invention to provide a power operator for the liftgate in such vehicles which enables remote operation to both raise and lower the liftgate.

It is another object of this invention to provide a power liftgate operator that facilitates manual operation if the power operator becomes inoperative.

In one aspect, this invention features a power operator for raising and lowering a vehicle liftgate to open and close an opening in the vehicle. A double-acting hydraulic cylinder powers the liftgate through a raise cycle when supplied with hydraulic pressure fluid at one end, and through a lower cycle when supplied with fluid at its other end. Hydraulic circuitry including first and second branches connects an electrohydraulic pump assembly and a hydraulic accumulator to both ends of the cylinder. A controller isolates the accumulator and actuates the pump assembly to direct fluid through the first branch to power an initial portion of the liftgate raise cycle. When the liftgate reaches a predetermined position, the controller deactuates the pump assembly and connects the accumulator to the first branch of the circuitry to power the remainder of the liftgate raise cycle. Fluid is exhausted from the other end of the cylinder through a second branch of the circuitry to the pump assembly. The controller actuates the pump assembly to direct fluid through the second branch to power the liftgate lower cycle. Fluid exhausted from the cylinder through the first branch recharges the accumulator.

In one embodiment, the pump assembly includes a single direction motor-driven pump and a directional valve for selectively connecting the pump to the first and second branches of the circuitry.

In another embodiment, the pump assembly includes a bi-directional motor-driven pump selectively connectable to the first and second branches of the circuitry.

In another aspect, this invention features a control valve for selectively connecting the accumulator to the first branch of the circuitry to enable fluid in the accumulator to assist manual raising of the liftgate when the power operator is disabled, and to enable recharging of the accumulator during manual lowering of the liftgate.

In a further aspect of this invention, the accumulator stores hydraulic fluid at a pressure significantly lower than pump pressure. Preferably, the accumulator is shaped to conform to an available niche in the vehicle structure to conserve space.

These and further objects and features of this invention will become more readily apparent upon reference to the following detailed description of a preferred embodiment, as illustrated in the accompanying drawings, in which:

BRIEF DESCRIPTION OF THE DRAWINGS

FIG. 1 is view of a vehicle having a liftgate operated by a power operator according to this invention;

FIG. 2 is a schematic diagram of a hydraulic circuit of a first embodiment of the power operator of this invention, illustrating the circuit in the initial portion of the raise cycle;

DETAILED DESCRIPTION OF PREFERRED EMBODIMENTS

Figure 3:
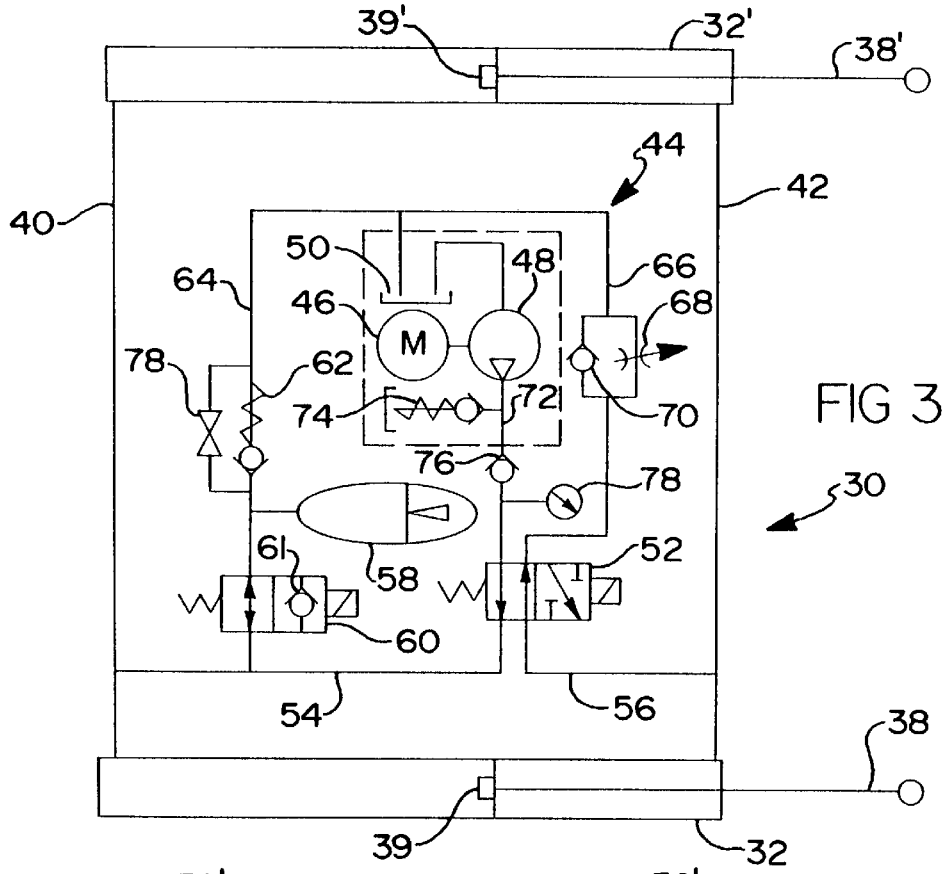
FIG. 3 is a schematic diagram similar to FIG. 2, but illustrating circuit in the final portion of the raise cycle.

Referring to FIG. 1, a sport-utility vehicle 20 has a rear hatch or opening 22 which provides access to the rear cargo storage area 24 of the vehicle interior. A tailgate, or liftgate 26 is hinged at its upper end 28 to vehicle 20. A power operator 30 (FIG. 2) includes pair of hydraulic cylinders 32, 32' which are pivoted to vehicle 20 at 34, 34' and have extensible rods 36, 36' pivoted to liftgate 26 at 38, 38'. Cylinders 32, 32' open and close opening 22 by extending and retracting cylinder rods 38, 38' to raise and lower liftgate 26 through a raise cycle and a lower cycle, as will now be explained.

FIG. 2 schematically depicts one embodiment of power operator 30. Here cylinders 32, 321 are supplied with hydraulic pressure fluid through a circuit that includes separate raise and lower branch circuits which include fluid lines 40 and 42 to raise and lower liftgate 26. A pump assembly 44 includes a motor 46 driving a single direction fluid pump 48 which is supplied with hydraulic fluid from a reservoir 50. Pump 48 supplies pressure fluid through one port of a solenoid-operated directional valve 52 and a line 54 to line 40 to extend cylinder rods 38, 38' and raise liftgate 26. Operation of valve 52 is controlled by an electronic controller (not shown) which forms no part of this invention.

Alternatively, valve 52 can be shifted to direct fluid through a line 56 to line 42 to retract rods 38, 38' and lower liftgate 26. The circuit also includes a fluid accumulator 58, a solenoid-operated accumulator control valve 60 which connects to line 54, and an accumulator relief/bleed valve 62, which connects to reservoir 50 through a line 64. The other port of directional control valve 52 connects to a reservoir line 66 through a variable orifice 68 in parallel make-up check valve 70. Pump 48 supplies fluid to control valve 52 through a feed line 72, having a pressure relief valve 74, through a check valve 76.

In operation, due to the kinematics of the installation, liftgate 26 requires an initial high force (requires hydraulic fluid pressure of 480 psi) to open and move during initial portion of the liftgate raise cycle. Thereafter, liftgate 26 then "gets over the hump" kinematically such that the force required for further opening movement suddenly drops and then further decreases gradually. Thus, the pressure requirement drops suddenly to 350 psi, then continues to gradually drop as the mechanical advantage of the cylinders increases.

Figure 5:
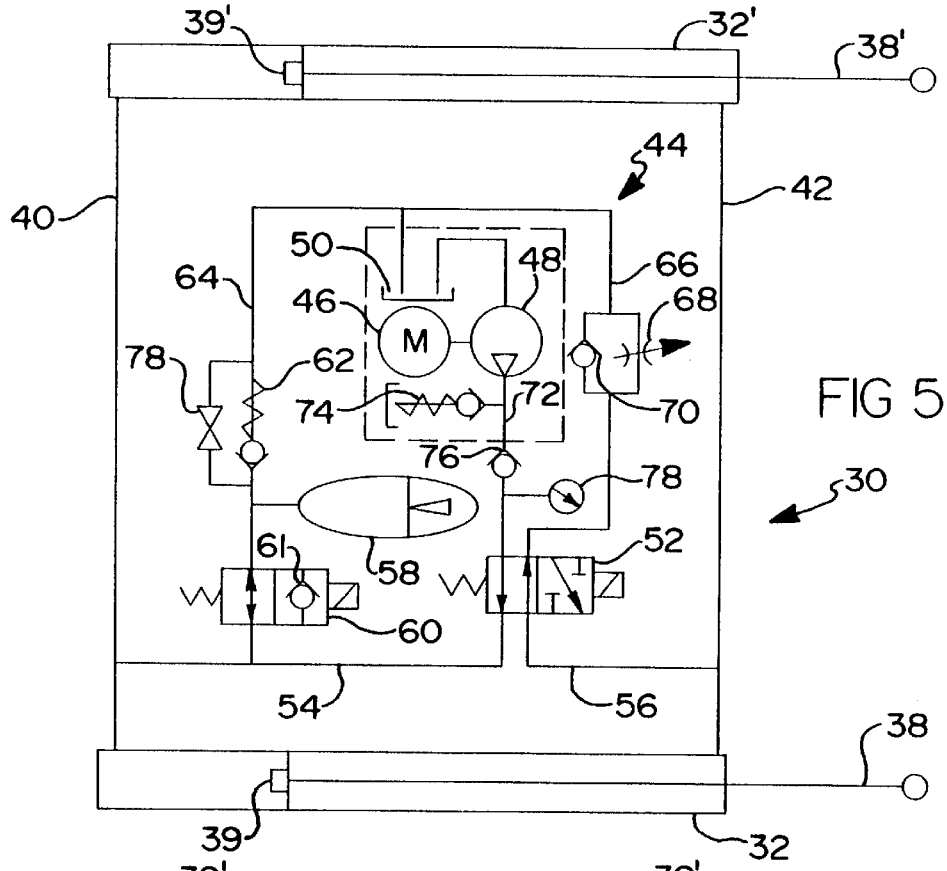
FIG. 5 is a schematic diagram similar to FIG. 2, but illustrating the circuit during manual raise and lower cycles.

The inoperative state of the circuit is shown in FIG. 5. To raise liftgate 26, the electronic controller unlatches liftgate 26, shifts valve 60 to put the circuit in condition shown in FIG. 2, and energizes motor 46 to activate pump 48. This pumps out 480 psi fluid through valve 52 and lines 54 and 40 to the blind ends of cylinders 32' which extend rods 38, 38' to begin opening the liftgate. The ballcheck 61 in valve 60 prevents pressure fluid flow into accumulator 58, which is maintained at 350 psi. When a system pressure transducer (not shown) detects a pressure drop in line 22 to 350 psi, the controller cuts out motor 46 which stops pump 48 and shifts valve 60 to connect accumulator 58 to line 54, as shown in FIG. 3. This causes accumulator 58 to supply pressure fluid to further extend cylinder rods 38, 38' to complete the raise cycle. Liftgate 26 is held in its raised position by the force of pressure fluid in accumulator 58. Displaced fluid from the rod ends of cylinders 32, 32' dumps to reservoir 50 through lines 42 and 56, valve 52 and variable orifice 68.

Figure 4:
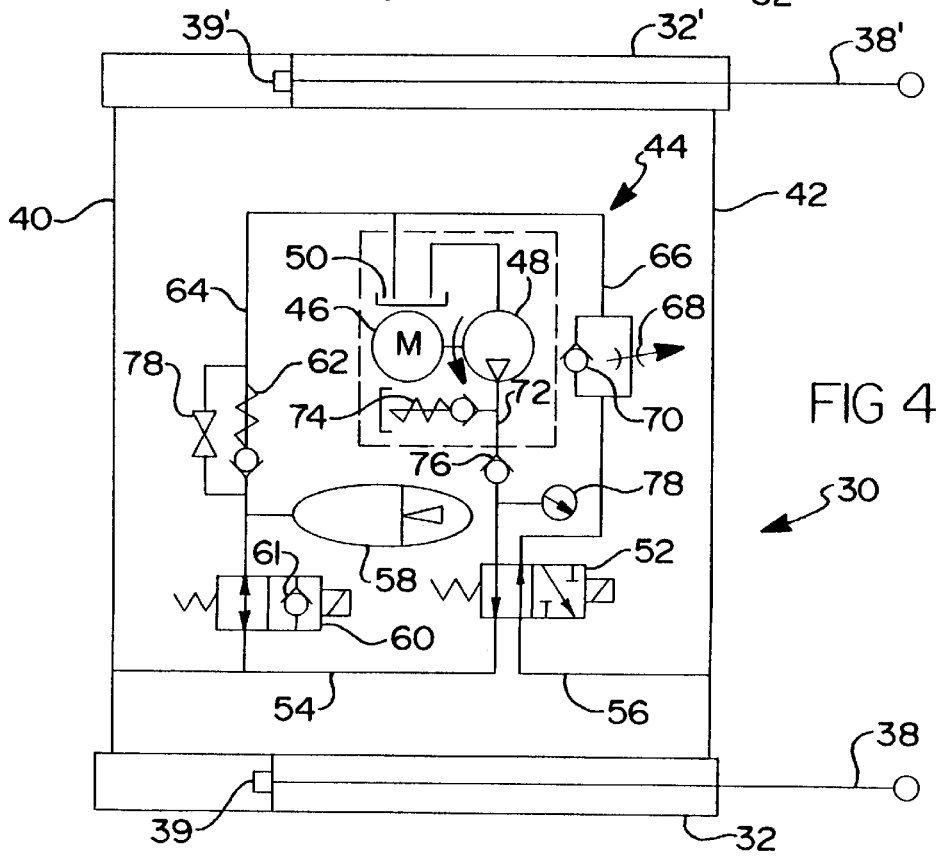
FIG. 4 is a schematic diagram similar to FIG. 2, but illustrating the circuit in the lower cycle.

To lower liftgate 26, the circuit is shifted to the FIG. 4 state. The controller shifts valve 52 and energizes motor 48 to activate pump 48, which supplies pressure fluid through valve 52 and lines 56 and 42 to the rod ends of cylinders 32, 32'. This retracts rods 38, 38' to lower liftgate 26. Fluid displaced from the cylinder blind ends flows through valve lines 40 and 54, and through control valve 60 to replenish accumulator 58. The pressure in accumulator 58 is limited by relief valve 62. Excess exhaust fluid flows through line 64 to reservoir 50.

As cylinders 32, 32' approach the end of their retraction stroke, hydraulic cushioning devices, or snubbers 39, 39' operate to cushion closure of liftgate 26. When liftgate 26 is closed, the rise in system pressure is sensed by the system pressure transducer 78 which signals the controller to deenergize motor 46, which stops pump 48, and returns the circuit to condition shown in FIG. 5.

Manual operation of liftgate 26 is readily accomplished with the circuit in its inoperative condition shown in FIG. 5. The power controller 30 is designed to enable manual operation if pump 48 is inoperative (car battery dies, etc.). Since the system is in the FIG. 5 inoperative condition, manual opening of the gate is aided by fluid in accumulator 58. Initially, only enough manual force to supplement the 350 psi accumulator force to a 480 psi force to "get over the hump" is required; when the force requirement drops, accumulator 58 alone does the work. Fluid forced out of the cylinder rod ends dumps through lines 42 and 56, through valve 52 and variable orifice 68 to reservoir 50 through line 66, as described above. As in powered operation, liftgate 26 is held raised by the fluid pressure in accumulator 58.

Manual lowering of liftgate 26 forces fluid out of the cylinder blind ends through lines 40 and 54 and through valve 60 to recharge accumulator 58. Manual force is assisted by the weight of the lowering gate via gravity. Fluid to replenish the expanding volumes in the cylinder rod ends is sucked out of reservoir 50 through line 66 and ball check 70 and through lines 56 and 42 into the cylinder rod ends. The manual force required for manual operation is thus reduced in the raise cycle by pressure fluid supplied by accumulator 58, and in the lower cycle by gravity. This manual cycle can be repeated.

Figure 6:
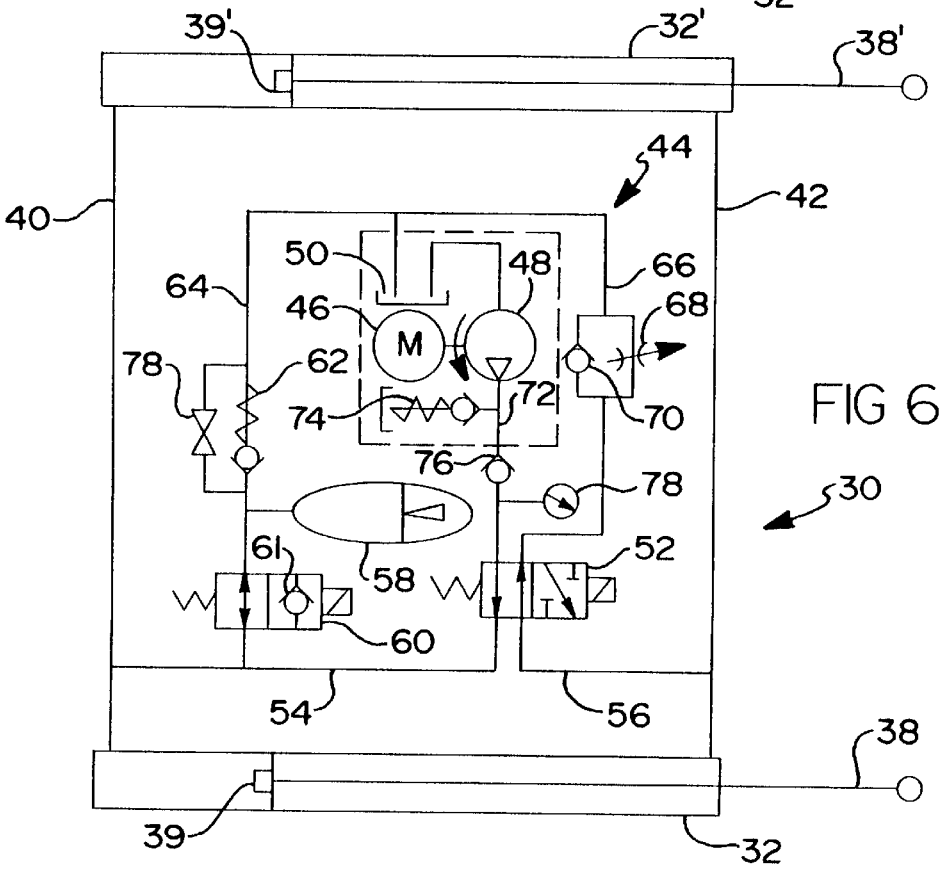
FIG. 6 is a schematic diagram similar to FIG. 2, but illustrating the circuit during accumulator recharging.

Should system leakage cause the pressure in accumulator 58 to drop, the controller will shift the circuit to the FIG. 6 condition in which motor 46 is energized to operate pump 48 to recharge accumulator 58.

Figure 7:
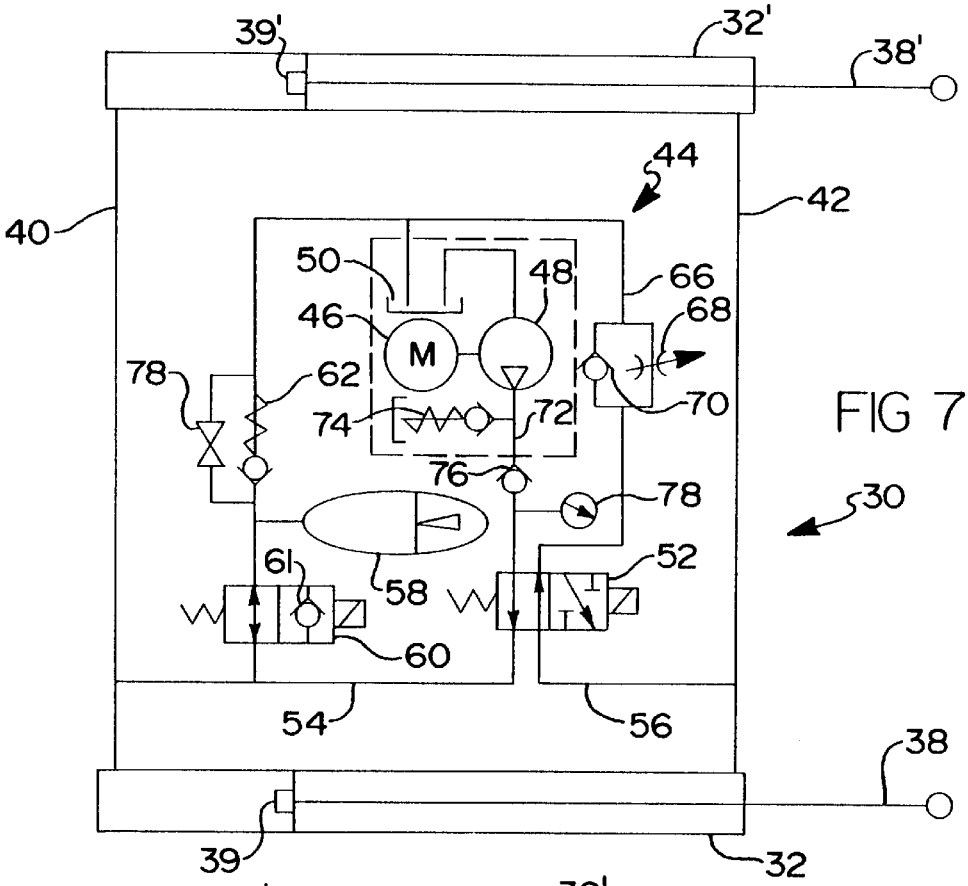
FIG. 7 is a schematic diagram similar to FIG. 2, but illustrating the circuit during accumulator bleed.

Reservoir 50 is designed to be large enough to hold all system fluid during system maintenance and repair, which requires accumulator bleed-off. This is shown in FIG. 7, in which the manual bypass 78 in relief valve 62 is opened to bleed accumulator 58 to reservoir 50 through line 64.

Another embodiment of this invention is shown in FIGS. 8–14, and uses many of the same circuit elements as in the FIGS. 2–7 embodiment. Here, the same reference numbers are used for elements identical to those in FIGS. 2–7, while similar elements which perform the same function as in the FIGS. 2–7 embodiment are designated by the same reference numbers increased by 100.

Thus, in this embodiment a reversible motor 146 drives a reversible, or bidirectional pump 148 which is used in place of the single direction pump 48 and the directional control valve 52 of the first embodiment. Pump 148 draws fluid out of the rod ends of cylinders 32, 32' and pressurizes it for delivery through a check valve 76 and lines 54 and 40 into the blind ends of cylinders 32, 32' to extend cylinder rods 38, 38'. Since the volume of the cylinder blind ends is greater than the rod ends, pump 148 draws makeup fluid from reservoir 50 through one side 80 of a rocker-operated double ball check valve 82, while outlet pressure keeps the other side 84 closed.

Figure 8:
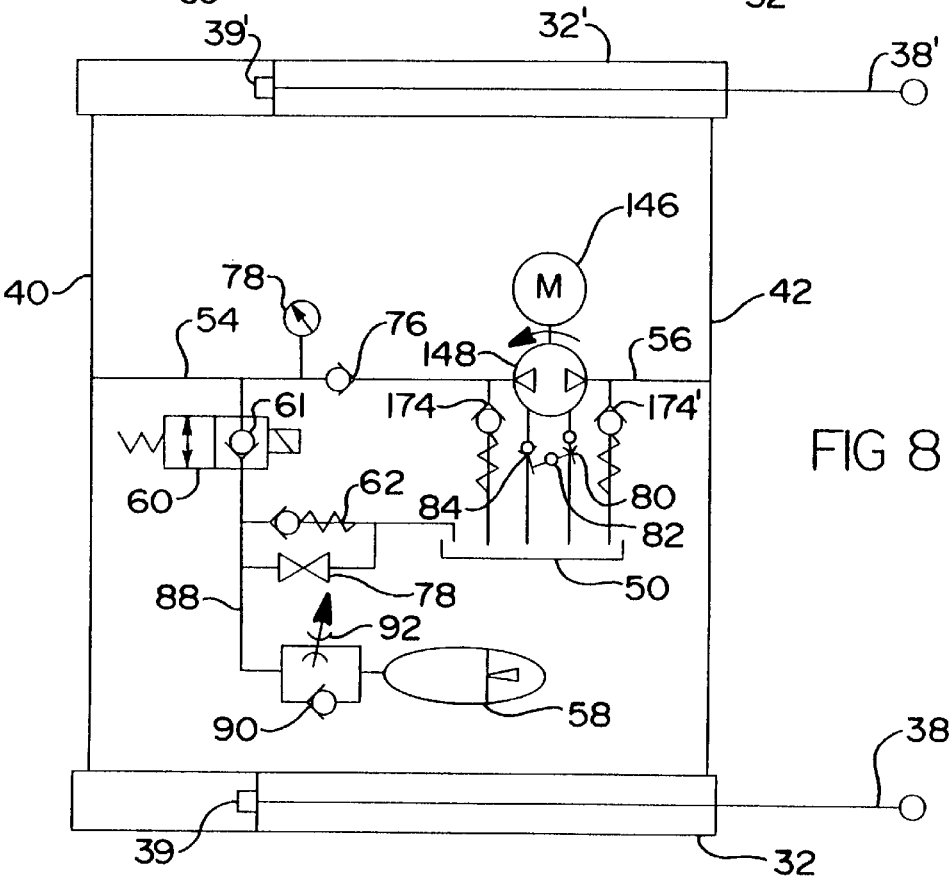
FIG. 8 is a schematic diagram of a hydraulic circuit of a second embodiment of the power operator of this invention, illustrating the circuit during the initial portion of the raise cycle.
Figure 9:
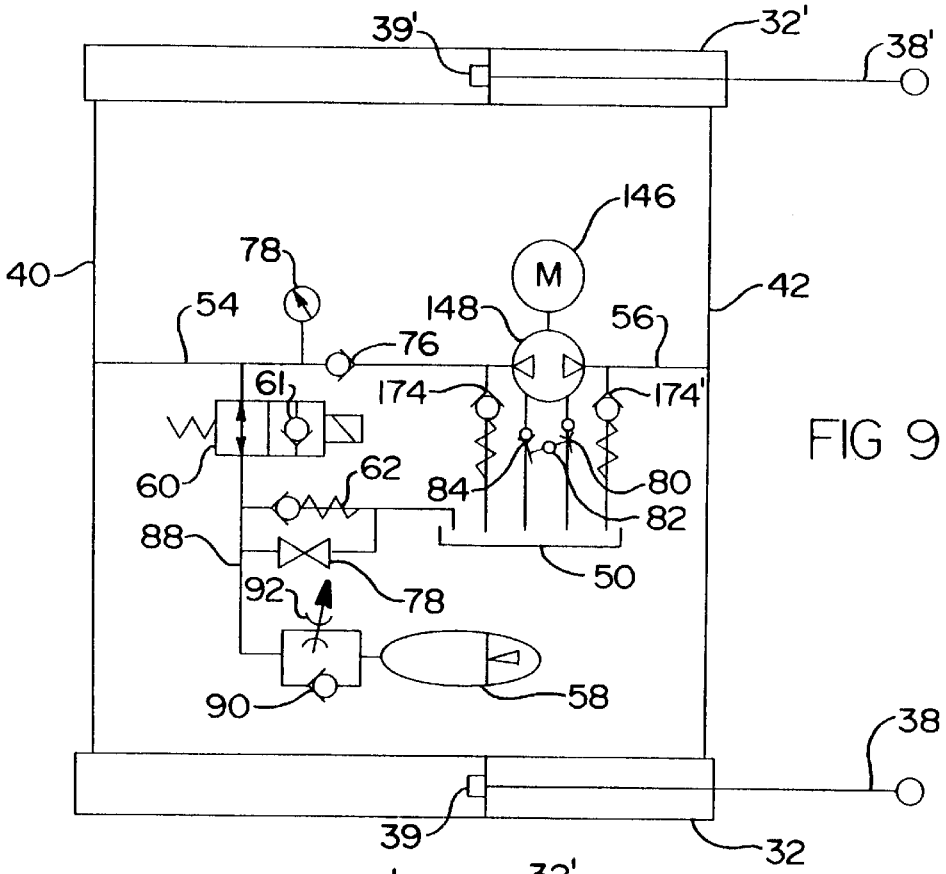
FIG. 9 is a schematic diagram similar to FIG. 8, but illustrating the circuit during the final portion of the raise cycle.

As in the first embodiment, pump 148 operates only during the initial phase of the liftgate raise cycle, as depicted in FIG. 8. Then pump 148 is shut off, as in FIG. 9, and accumulator 58 completes the raising of the tailgate as described above. Accumulator 58 is connected to control valve 60 by a supply line 88 through a ball check 90 and a parallel variable orifice 92.

Figure 10:
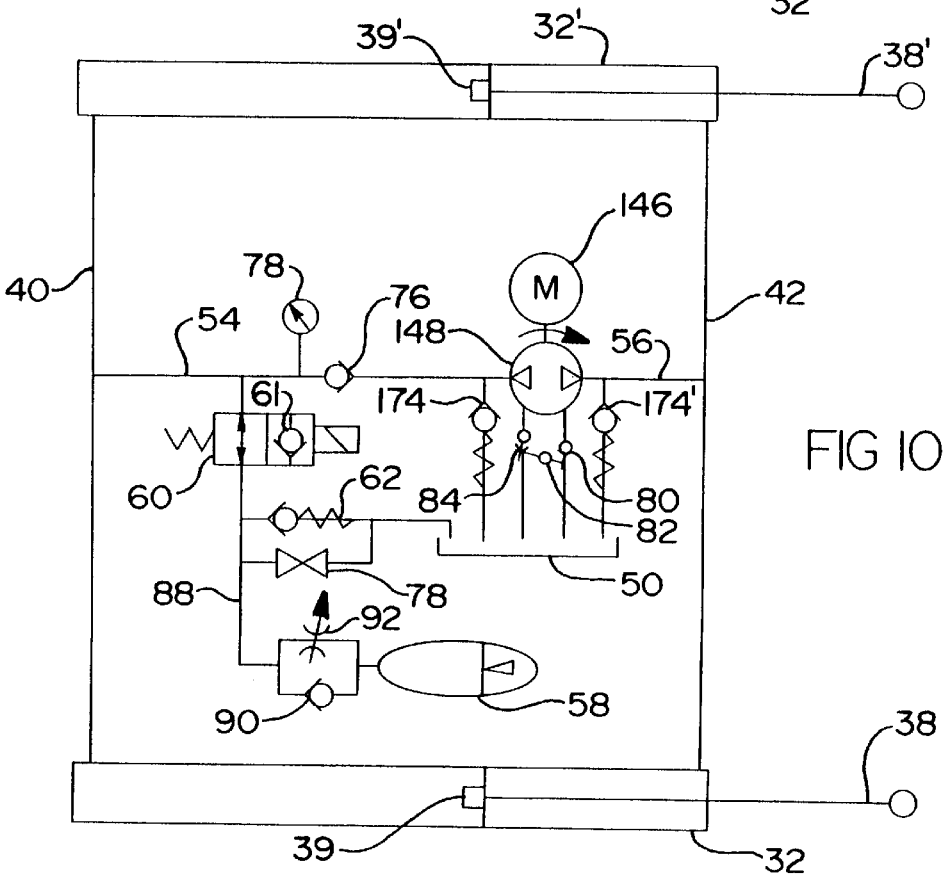
FIG. 10 is a schematic diagram similar to FIG. 8, but illustrating the circuit during the lower cycle.

Lowering of tailgate 26 is depicted in FIG. 10, where pump 148 is reversed to draw fluid from reservoir 50 through the unseated side 84 of valve 80, pressurize it and supply it to the cylinder rod ends through line 42. Fluid forced out of the cylinder blind ends replenishes accumulator 58, with the excess, resulting from the differential cylinder end volumes, dumping to reservoir 50 through relief valve 62.

Figure 11:
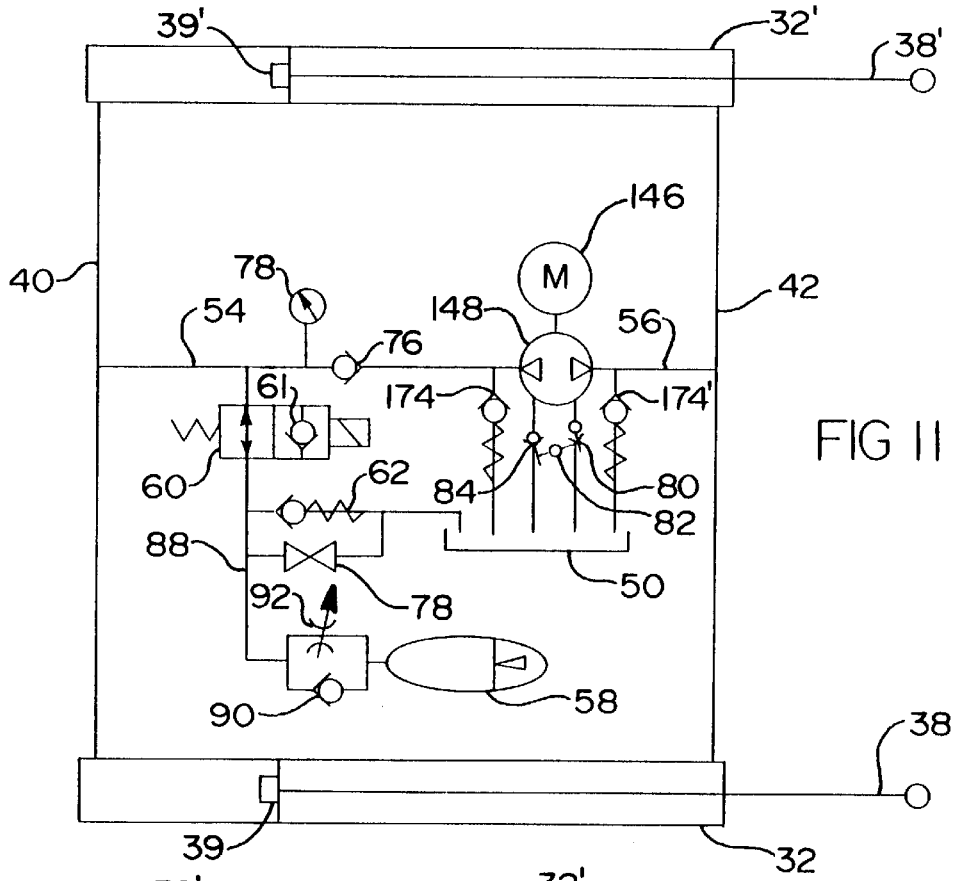
FIG. 11 is a schematic diagram similar to FIG. 8, but illustrating the circuit during manual raise and lower cycle.
Figure 12:
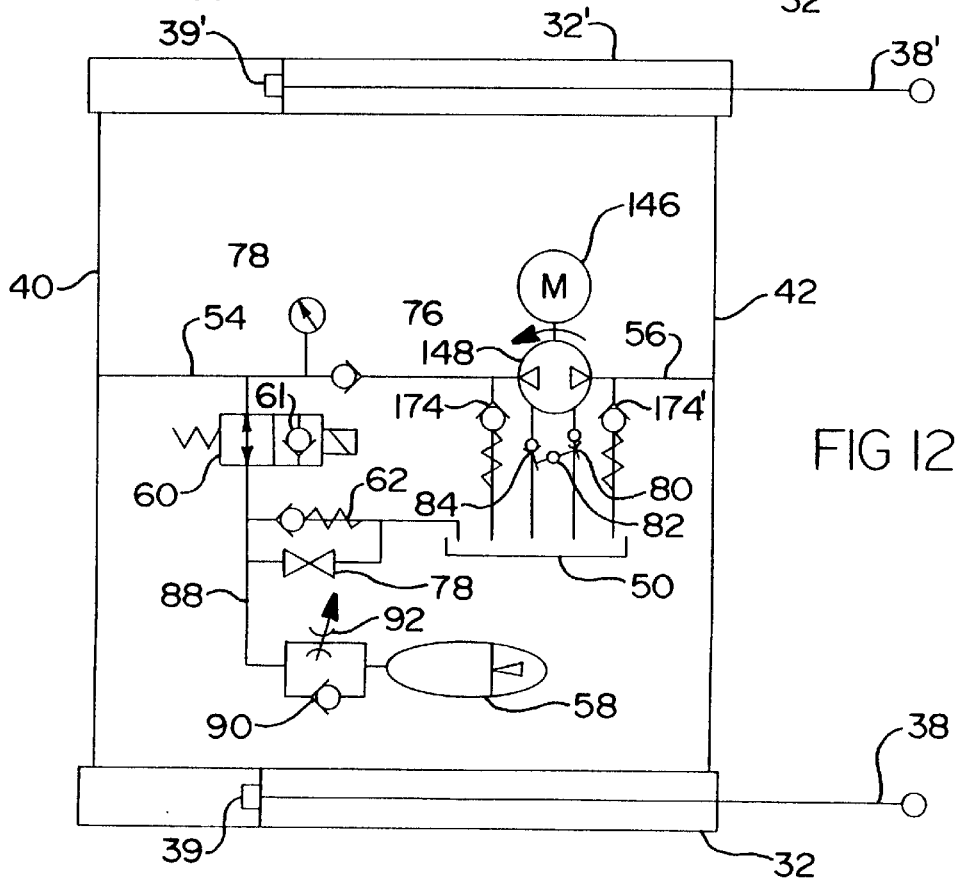
FIG. 12 is a schematic diagram similar to FIG. 8, but illustrating accumulator charge.
Figure 13:
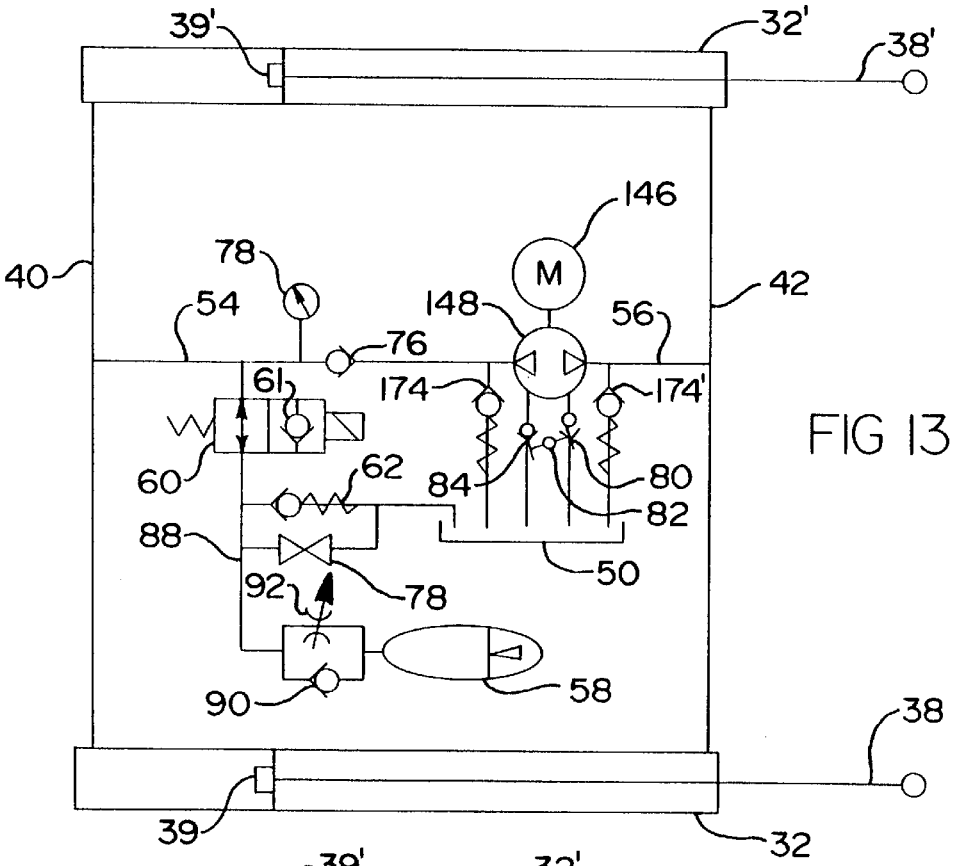
FIG. 13 is a schematic diagram similar to FIG. 8, but illustrating the circuit during accumulator bleed.

FIG. 11 shows the fluid circuit positioned for manual operation, with motor 46 deenergized. FIG. 12 shows the circuit in condition for charging accumulator 58, with valve 60 open and pump 148 pressurizing lines 54 and 88 to charge accumulator 58 through ball check 90. FIG. 13 illustrates accumulator bleed condition, with manual valve 78 open to reservoir 50 and accumulator 58 bleeding at a rate controlled by variable orifice 92.

Figure 14:
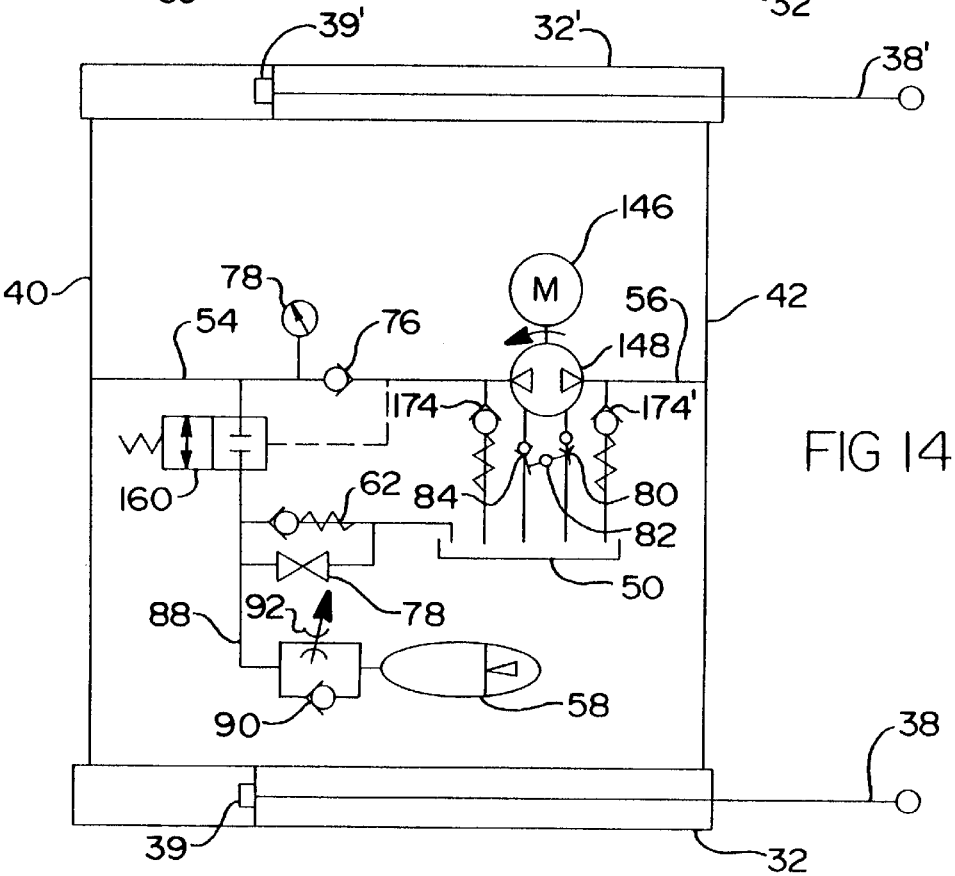
FIG. 14 is a schematic diagram of variant of the hydraulic circuit shown in FIG. 8, illustrated during power raise cycle.

A variant of the FIGS. 8–13 embodiment is illustrated in FIG. 14. Here, the solenoid-operated accumulator control valve 60 is replaced by a pilot-controlled valve 160. Instead of having the one-way ball check in one valve port, which prevents accumulator overcharging by pump 148, the closed port accomplishes the same function more simply. Whereas the ball check in valve 60 enables the accumulator to take over when pump 148 stops, the spring in valve 160 shifts the valve when pump pressure, and consequently pilot pressure, falls.

Thus, all embodiments of this invention illustrated in FIGS. 1–14 illustrate a power lift for a liftgate which features:

(a) providing controlled power opening and closing of the liftgate;

(b) the use of high pressure pumped fluid for only a small portion of the opening cycle, then switching to lower pressure accumulator fluid for the larger portion of the cycle, (c) requiring the accumulator to maintain only a much lower pressure by isolating the accumulator from pump pressure when the pump is operating, (d) using the pump to indirectly recharge the accumulator for the next operating cycle by using cylinder exhaust fluid during liftgate closing, and (e) providing for power-assisted manual liftgate operation in the event of a power failure by utilizing the accumulator.

While only preferred embodiments of this invention have been illustrated and described, obvious modifications thereof are contemplated within the scope of the following claims. For example, in the FIGS. 2–7 embodiment, the ball check 61 in accumulator control valve 60 could be eliminated in certain applications. Also, the combination variable orifice 68 and parallel make-up check valve 70 in all embodiments could be eliminated in certain applications.

I claim:

1. In a vehicle having a liftgate which opens and closes an opening in the vehicle, a power operator comprising a double-acting hydraulic cylinder pivotally interconnecting the vehicle and the liftgate for raising the liftgate through a raise cycle when supplied with hydraulic pressure fluid at one end, and for lowering the liftgate through a lower cycle when supplied with fluid at its other end, an electrohydraulic pump assembly, a hydraulic accumulator, hydraulic circuitry having first and second circuit branches interconnecting the pump, accumulator and both ends of the cylinder, and control means for actuating the pump assembly to direct fluid through the first circuit branch to the cylinder one end during an initial portion of the liftgate raise cycle while isolating the accumulator from the circuitry until the liftgate reaches a predetermined position, and thereafter deactuating the pump assembly and connecting the accumulator to the first circuit branch to discharge fluid to the cylinder one end during the final portion of the liftgate raise cycle, while exhausting fluid from the cylinder other end through the second circuit branch to the pump assembly, said control means actuating the pump assembly to direct fluid through the second circuit branch to the cylinder other end during the liftgate lower cycle, while exhausting fluid from the cylinder one end through the first circuit branch to the recharge the accumulator.

2. The power operator of claim 1, wherein the pump assembly includes a single direction motor-driven pump and a directional valve for selectively connecting the pump to the first and second branches of the circuitry.

3. The power operator of claim 1, wherein the pump assembly includes a bi-directional motor-driven pump connected to the first and second branches of the circuitry.

4. The power operator of claim 1, wherein the control means include a control valve for selectively connecting the accumulator to the first branch of the circuitry, said control valve being open to enable fluid in the accumulator to assist manual raising of the liftgate when the power operator is disabled and to enable recharging of the accumulator during manual lowering of the liftgate, open during the final portion of the liftgate raise cycle and during the liftgate lower cycle when the power operator is enabled, and closable to isolate the accumulator during the initial portion of the liftgate raise cycle.

5. The power operator of claim 4, wherein the accumulator stores hydraulic fluid at a pressure significantly lower than pump pressure.

6. The power operator of FIG. 5, wherein the power operator includes a reservoir having the capacity to hold the hydraulic fluid of all components of the power operator to facilitate maintenance, said reservoir being shaped to conform to the dimensions of available vehicle space to maximize space utilization in the vehicle.

7. In a vehicle having a liftgate which opens and closes an opening in the vehicle, a power operator comprising a pair of double-acting hydraulic cylinders pivotally interconnecting the vehicle and the liftgate which extend to raise the liftgate through a raise cycle when supplied with hydraulic pressure fluid, and retract to lower the liftgate through a lower cycle when supplied with hydraulic pressure fluid, an electrohydraulic pump assembly, a hydraulic accumulator, hydraulic circuitry having first and second circuit branches interconnecting the pump, accumulator and both cylinders, and control means for actuating the pump assembly to direct fluid through the first circuit branch to extend the cylinders during an initial portion of the liftgate raise cycle while isolating the accumulator from the circuitry until the liftgate reaches a predetermined position, and thereafter deactuating the pump assembly and connecting the accumulator to the first circuit branch to further extend the cylinder during the final portion of the liftgate raise cycle, while exhausting fluid from the cylinder through the second circuit branch to the pump assembly, said control means actuating the pump assembly to direct fluid through the second circuit branch to retract the cylinders during liftgate lower cycle, while exhausting fluid from the cylinders through the first circuit branch to the recharge the accumulator.

* * * * *